United States Patent [19]

Sanderson

[11] Patent Number: 4,487,317

[45] Date of Patent: Dec. 11, 1984

[54] STACKING WIRE FOR PRODUCE TRAYS

[75] Inventor: Robert C. Sanderson, Buffalo, N.Y.

[73] Assignee: Better Wire Products, Inc., Buffalo, N.Y.

[21] Appl. No.: 424,504

[22] Filed: Sep. 27, 1982

[51] Int. Cl.[3] ..... B65D 5/46

[52] U.S. Cl. ..... 206/509; 229/52 AW; 229/DIG. 11

[58] Field of Search ..... 206/503, 509, 510, 821; 220/94; 229/34 HW, 52 AN, DIG. 11, 52 AM, 16 C, 52 AW

[56] References Cited

U.S. PATENT DOCUMENTS

| | | | |
|---|---|---|---|
| 2,990,995 | 7/1961 | Wessel | 229/52 AW |
| 3,106,332 | 10/1963 | Dieguez | 229/34 HW |
| 4,227,642 | 10/1980 | Ortel | 229/34 HW |

OTHER PUBLICATIONS

"Handle With Care", brochure, Better Wire Products, Inc., earliest date 9-26-82.

*Primary Examiner*—Stephen Marcus
*Assistant Examiner*—David Voorhees
*Attorney, Agent, or Firm*—Raymond F. Kramer

[57] ABSTRACT

A stacking wire for produce trays is made from a length of wire, preferably a uniform round high tensile strength steel wire of at least 14 gauge, bent into an elongated open U with both sides thereof diverging downwardly to open ends at which they are bent outwardly to form further outwardly diverging legs which terminate in hook-shaped feet, with the hook openings facing outwardly and with the ends of such hooks bending upwardly. A stacking wire of the type described, when installed in a produce tray by being inserted through a slotted bottom portion and then through a top opening in such tray, will be compressed by such tray slots so that the sides thereof are essentially parallel, and the hook shaped feet of the wire will be held in place pressing against end walls of the bottom slot of the produce tray and with the ends of the wire digging into the tray bottom to help to maintain the wire in position even when additional tray(s) are stacked on the supporting tray and the stacking wire. The legs diverging from the wire sides are inclined at least 20° from continuations of such sides, and preferably 24° or more, the legs include extensions connecting to the feet, which extensions are substantially parallel to the sides, the hook portions of the feet include upper ledge sections long enough and parallel enough to the tray bottom to prevent accidental release of the stacking wire from the produce tray bottom slots during stacking operations, and the sides of the stacking wire are sprung apart before installation, whereby the closed end portions of the hooks press against the bottom slot end walls even when such walls are farther apart than upper slot end walls.

10 Claims, 3 Drawing Figures

STACKING WIRE FOR PRODUCE TRAYS

This invention relates to a stacking wire for stackable produce trays and the like. More particularly, it relates to such a stacking wire of generally open U type construction having outwardly further diverging legs and hook-shaped foot portions with upper ledge type constructions therein which prevent accidental release of the stacking wires during stacking of additional trays on the tray in which the wires are installed, and during transportation of such stacked trays.

Various fruits and berries, such as strawberries and cherry tomatoes, have long been packed in relatively shallow trays, which are stacked one atop the other for storage and shipment. Whereas originally such trays were of wood, in recent years they have usually been made of corrugated paperboard. Generally, the trays are uncovered, except by an upper tray or a cover for the stack, and the trays include provisions in their end walls for insertions of wire tray handles or stacking wires that facilitate stable and regular stackings of the trays. Although some such wires are made for top insertions into the berry tray ends, and consequently, may be shorter, thereby saving material (wire), for best stacking stability bottom insertion wires, which pass between end walls of the stacking trays, are often preferred.

Bottom insertion type stacking wires of various structures have been described in the literature, and have been patented and marketed. Generally, such wires have been made of steel and have been round in cross-section. While different constructions have been employed to bias the open bottom ends of such wires outwardly, so that they will press against inner walls of bottom slots in the produce trays, it has been preferred to pre-spring sides of such wires outwardly so that hook-like openings at the bottoms thereof will press against end walls of slots in tray bottoms, thereby holding the stacking wires in place.

A preferred embodiment of such prior art stacking wires is that which has been marketed by Better Wire Products, Inc. as part No. NS-153R. However, while such stacking wires have been employed with some success, the product of the present invention, at least in part by virtue of its outwardly trussed leg segments and divergent spring tension, is considered to be superior to them. The invented wire is especially effective in gripping or locking around product tray slots wherein the lower or bottom slot ends are farther apart than the corresponding upper slot ends, either due to initial tray construction of such type or due to the wire cutting through the corrugated paperboard during installation or in use. Although the NS-153R stacking wires appear to represent the closest prior art to the present invention, U.S. patent application Ser. No. 311,964, now abandoned filed by Ronald W. Weekley and Edward D. Poe on Oct. 16, 1981, may also be considered as being of some relevance with respect to the construction of the wire feet, as may be the disclosures of U.S. Pat. Nos. 2,903,176, 2,971,232 and 2,987,198, although it should be clear from each of these disclosures that the reference wires are of significantly different overall constructions from those of this application, and do not possess significant advantages of the invention.

In accordance with the present invention a stacking wire for stackable produce trays and the like comprises a unitary length of wire bent so as to form an elongated opened "U" shape with a pair of sides thereof joined together at an upper end and diverging from said end to open ends, at which both sides are bent outwardly to form further outwardly diverging legs which are at an angle of at least 20° with respect to continuations of the wire sides, which terminate in hook-shaped feet, with the hook openings facing outwardly and with the ends of such hooks bent upwardly, so that when the wire is installed in a produce tray, by being sequentially inserted up through a slotted bottom opening and a slotted top opening in such tray, it will be compressed so that the sides thereof are essentially parallel and so that the hook-shaped feet of the wire are held in place with respect to the bottom slot of the produce tray and have the ends thereof digging into such tray bottom. Also within the invention are produce trays with such stacking wires installed and sets of trays stacked on other trays, using the stacking wires for positioning and for maintaining the stack secure.

The invention will be readily understood by reference to the present specification, including the following description, taken in conjunction with the drawing, in which.

Figure 1:
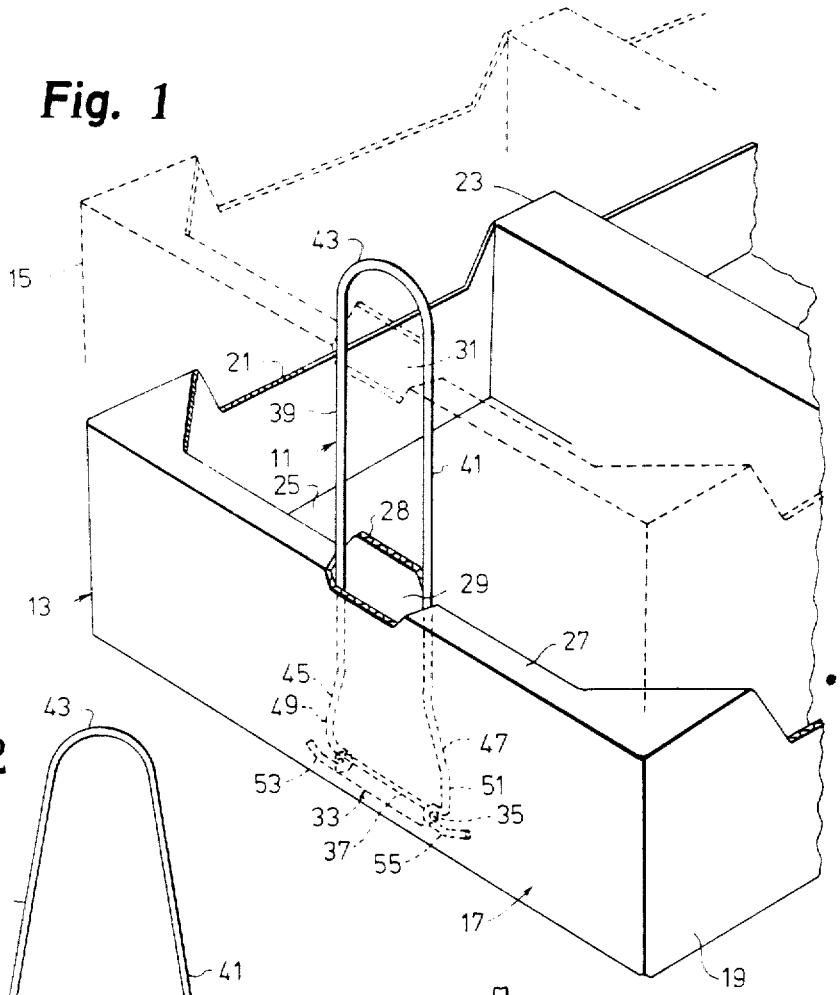
FIG. 1 is a partial perspective-type view of a part of a produce tray of the berry tray type, with a stacking wire of this invention installed in an end thereof and with part of a second stacked tray being illustrated in phantom atop the base tray.

In FIG. 1 stacking wire 11 is shown installed in berry tray 13, which has berry tray 15 in place on top of it, held in position by wire 11. Produce tray 13 includes outer end wall 17 and opposing and corresponding inner wall 28, a tab extension of which is illustrated, side walls 19 and 21, optional middle separating wall section 23 and bottom 25. Ends 17 and 28 terminate in an upper part 27 which has an opening 29 therein, through which wire 11 passes. Wire 11 also passes through a bottom opening, not shown, in the upper tray, and an upper opening 31 therein. Of course, wire 11, in passing behind wall 17 and a corresponding wall of the upper tray, passes in front of corresponding inner end walls, not shown in detail, which, with the mentioned walled openings and others to be described, hold the wire in vertical orientation. Tray bottom 25 also includes slot 33, which has end walls 35 and side walls 37. Similar openings and walls are present in upper tray 15 but are not illustrated. Of course, wire 11 passes through the bottom slot (not illustrated) of tray 15, which corresponds to slot 33 of tray 13.

Figure 2:
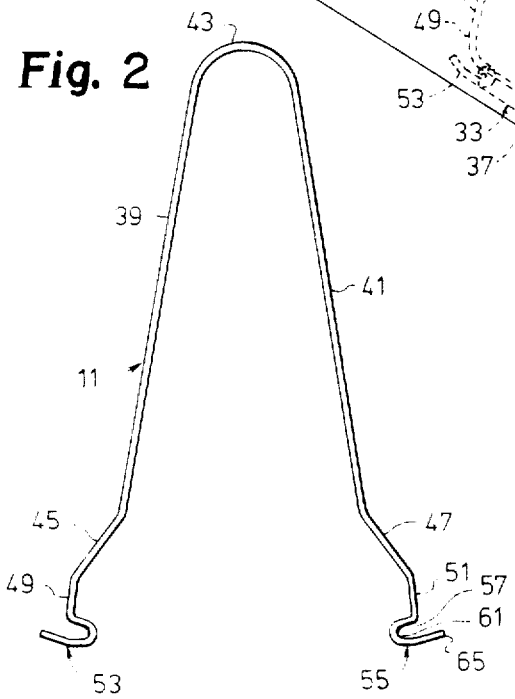
FIG. 2 is a front elevational view of the stacking wire of FIG. 1, in unstressed, pre-sprung position.
Figure 3:
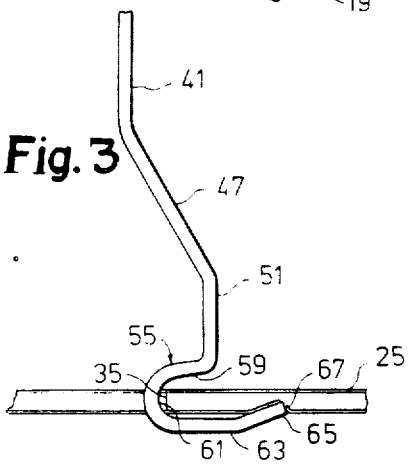
FIG. 3 is an enlarged view of an end part of the wire of FIGS. 1 and 2, showing how such part fits against an end wall of a holder slot of the tray bottom.

Wire 11, which can be seen in at least partially pre-sprung planar form in FIG. 2, includes sides 39 and 41 which are joined together at curved top portion 43, which is essentially semi-circular in shape. Sides 39 and 41, which subtend an angle in the range of 20° to 24°, extend divergently downwardly to where they are each bent outwardly at least 20° and preferably at least 24° from the continuations of the sides, to form further outwardly diverging legs 45 and 47. Although it is not always required that such legs include extensions below the main leg portions which parallel the wire sides before they terminate in hook-shaped feet, it is highly preferred that such extensions be present and they are illustrated in the drawing. At the bottoms of leg extensions 49 and 51 the wire is bent to hook-shaped feet 53 and 55, respectively. Referring only to foot 55, with the understanding that foot 53 is similarly constructed, it will be noted that the open portion 57 of hook 55 faces outwardly and that, as shown in FIG. 3, such foot includes a ledge portion 59, a bend 61, a flat 63 and a digging or piercing end 65, and when the stacking wire is installed in a produce tray, bend 61 of hook 55 presses against slot end wall 35 and end 65 pierces the bottom 25 of tray 13 at 67.

To install the invented stacking wires is very simple. In fact, they can be readily installed in a matter of seconds, which is one of the important advantages of the present structure. All that is needed is for the worker to hold the wire and insert it upwardly through the aligned bottom and top openings in the end of a produce tray, after which it may be pulled upwardly to dig into the tray bottom and lock in position. Then, after the wires are installed in both ends of the produce tray the next tray may be stacked thereon. For multiple tray stacks each tray or pair of trays being stacked will already have wires installed at each end of the tray(s).

The present stacking wires differ significantly in several respects from the NS-153R wires mentioned previously. One such difference is in having the outwardly flaring or diverging leg sections directed outwardly at a significantly greater angle (with respect to side continuations). This angle will be at least 20° and preferably is more than 24°, sometimes more preferably being about 25°. Normally the angle will not be greater than 30° and preferably will be no more than 26°. Such outward flaring, in effect, moves the hooking portions of each of the feet outwardly at least 0.8 cm. and sometimes as much as 1.0 or 1.3 cm. beyond the position that such would otherwise normally have assumed. The outward flaring also serves to transmit downward blows onto the closed end of the wire, such as are encountered during stacking operations, into divergent force vectors, thereby decreasing the probability that such a blow will drive the wire directly down and out of the bottom slot. At the same time such flaring allows the wire sides to contact the slot walls at the top of the produce tray and still provides for good positive contact of the hook-shaped foot portions of the stacking wire with the bottom slots, even when those bottom slots are longer than the upper slots (sometimes they are from 3 to 15 mm. longer, such as 4 to 10 mm.).

At the ends of the outwardly diverging legs illustrated are leg extensions which parallel or substantially parallel the installed wire sides. Such extensions serve to create stronger functional bends to form the foot portions of the wires and they facilitate the making of ledge portions that are horizontal or near horizontal in installed position, without overly straining the wire so that it may be weakened, which could cause the feet to break off during installation or during use. Ledge portion 59 is shown in FIG. 3 as substantially horizontal, as it also indicated in FIGS. 1 and 2. However, it is possible to have the ledge inclined slightly upwardly providing that the hook is not released during use of the wire. In any case, the angle of the ledge with the horizontal (when installed) will normally be no greater than about 15° and the upper ledge portion will be at least 0.6 cm. long, preferably at least 0.8 cm. long, and possibly as much as 1 cm. long. With ledges thus being long enough and parallel enough to the tray bottom and in such a range of inclinations (preferably horizontal or even sometimes downwardly inclined in installed position) and sizes, the ledge helps the foot to hold better to the slot end, preventing accidental dislodging of the stacking wire, especially during the stacking of additional trays down over the closed end portion 43 of the wire. Similarly resisting dislodging will be the bent tips which are preferably bent up at least 10° and more preferably at least 20° from the horizontal, so that they will become embedded in the tray bottom. Such embedding of the ends also prevents snagging on supporting surfaces, such as shed floors and truck beds, which can also be contributory to accidentally dislodging the stacking wire from the tray slot.

The wire employed will preferably be a high tensile strength steel wire which will be formed in a pre-sprung divergent mode which will resiliently press outwardly against the slot walls to hold the wire in position. Various high tensile strength steels may be satisfactorily employed, such as types with tensile strengths in the range of 4,000 to 8,000 kg./sq. cm. While high tensile steels are preferred, various alloy steels may also be utilized. Other metals are normally softer and therefore less acceptable than steels but sometimes, as in the case of aluminum, tensile strength may be improved by cold working to produce properties approaching those of the steels. Generally however, the preferred material of construction for the present wire will be steel or an alloy of steel. In addition to tensile strength, the gauge of the steel will be important in determining the stacking wire strength and the force with which the wire will hold to the produce tray slot end walls. It has been found that wire gauges in the range of 10 to 14 (U.S. Steel Wire Gauge) can be employed but preferably the gauge will be 12 or 13 for desired strength and ease of installation. By using such gauge wires at a desired pre-sprung opening excellent gripping power for the stacking wire is obtained and the installer's fingers are not injured or irritated excessively by movements during multiple installations. Also, wires of such diameters facilitate 90° bendings of the upper portions thereof to lock a cover sheet in place on the top of a pallet of trays. As to the pre-springing of the wire, this will create a distance between the hooks which will usually be of a width about 5 to 10 cm. greater than the width of the slot, preferably from 7 to 9 cm. greater. Such distance will usually be in the range of about 180 to 250%, preferably 200 to 225% of the slot width. Thus, the distance between the pre-sprung wire inside hook walls will be about twice the length of the bottom tray slot opening. For example, the wire walls could be about 12.7 cm. apart (pre-sprung) for tray slots that are about 5.7 cm. long. Stated differently, relating the wire width to its height, the distance between the hooks will usually be within 30 to 50% of the wire height.

The combined effect of the fundamental changes in the wire construction made in accordance with this invention contributes to obtaining of a greatly improved practical result. Thus, whereas prior art wires, although seemingly adequate in many instances, sometimes would accidentally be released or knocked out of place by downward pressures, causing expensive losses of costly produce, such as strawberries, the present wires, with their improved strength and adaptability to tightly fitting and locking onto corrugated paperboard or equivalent produce trays, have a markedly improved record of performance without stack shiftings and collapses. Little extra expense is involved in making the improved wires and no change in installation techniques needs to be learned. The new wires are as readily installed as prior art wires and are about as easily manufacturable, using automatic wire forming and cutting equipment. Yet, with the changes made from the prior art wires, those of this invention give the shipper better assurance of continuous and trouble-free operations.

The changes in wire shape, the modifications of the legs and hook-shaped feet and the various interrelationships of the different parts of the present stacking wires, which were arrived at as a result of experience and not from deduction only, are all important in producing the desired result, an easily installed wire that, with other such wires, holds the produce tray stack together. Although the art is always searching for more positively holding and more easily installable stacking wires many of the wires still being marketed can release stacks of expensive berries or other produce during handling or shipment, causing expensive losses to the owner or shipper. Thus, the finding that readily made, economical, easily installable and readily removable (when desired) wires of the present type are so effective in holding stacked produce trays together is considered to be surprising.

The invention has been described with respect to illustrations and preferred embodiments thereof but is not to be limited to these because it is evident that substitutes and equivalents may be employed without departing from it.

What is claimed is:

1. A stacking wire for stackable produce trays and the like which comprises a unitary length of wire bent so as to form an elongated opened "U" shape with a pair of sides thereof joined together at an upper end and diverging from said end to open ends, at which both sides are bent outwardly to form further outwardly diverging legs which are at an angle of at least 20° with respect to continuations of the wire sides and which terminate in hook-shaped feet, with the hook openings facing outwardly and with the ends of such hooks bent upwardly, so that when the wire is installed in a produce tray, by being sequentially inserted up through a slotted bottom opening and a slotted top opening in such tray, it will be compressed so that the sides thereof are essentially parallel and so that the hook-shaped feet of the wire are held in place with respect to the bottom slot of the produce tray and have the ends thereof digging into such tray bottom.

2. A stacking wire according to claim 1 wherein each leg extends outwardly at least 0.8 cm., extensions of leg portions are present which are substantially parallel to the wire sides and connect the diverging legs and the feet, and the hook portions include upper ledge sections which are long enough and parallel enough to the tray bottom to prevent accidental release of the stacking wire during stackings of produce trays on said wire.

3. A stacking wire according to claim 2 wherein the wire is a uniform circular cross-section, high tensile strength steel wire at least as thick as 14 gauge which is pre-sprung so that the distance between the parts of the feet that are intended to contact the produce tray slot walls, in such pre-sprung condition, is within 180 to 250% of such distance when the stacking wire is installed on a produce tray with the wire hooks holding to the slot walls thereof.

4. A stacking wire according to claim 3 which is substantially coplanar and in which, because of the presence of the outwardly diverging legs thereof, the hook-shaped feet, which include upper ledge portions which are at least 0.6 cm. long, tightly hold to the end walls of produce tray bottom slot openings when such end walls are farther apart than are the end walls of the produce tray upper slot openings.

5. A produce tray with a pair of stacking wires, each in accordance with claim 1, installed therein, which tray includes a bottom, vertical sides and vertical end walls, with aligned slots in the bottom and in the top portions of each of the end walls, wherein the stacking wires are installed vertically with the planes thereof substantially paralleling the tray ends so that the slots in the tops of the tray ends press the stacking wire sides together, and the stacking wires, due to the presences of the outwardly diverging leg portions thereof and the hook-shaped feet, tightly hold to the slot end walls at the bottom of the produce tray by pressing outwardly against such walls and resisting removal or dislodgement of the stacking wire from the tray when additional tray(s) is/are stacked thereon.

6. A produce tray according to claim 5 wherein each of the stacking wires is for stackable produce trays and the like and comprises a unitary length of a uniformly circular cross-section, high tensile strength steel wire at least as thick as 14 gauge, bent so as to form an elongated pre-sprung opened "U" shape with a pair of sides thereof joined together at an upper end and diverging from said end to open ends, at which both sides are bent outwardly to form further outwardly diverging legs which are at an angle of at least 20° with respect to continuations of the wire sides, which extend outwardly at least 0.8 cm., which have extensions which are substantially parallel to the wire side portions that are not further outwardly diverging and which extensions and legs terminate in hook-shaped feet, with the extensions connecting the diverging leg portions and the feet, which feet have hook openings facing outwardly, with the ends of such hooks being bent upwardly and with the hook portions including upper ledge portions which are at least 0.6 cm. long and long enough and parallel enough to the tray bottom to tightly hold to the end wall of produce tray bottom slot openings when such end walls are farther apart than are the end walls of the produce tray upper slot openings, to prevent accidental release of the stacking wire during stackings of produce trays on said wire, which wire is pre-sprung so that the distance between the parts of the feet that are intended to contact the produce tray slot walls, in such pre-sprung condition, is within 180 to 250% of such distance when the stacking wire is installed on a produce tray with the wire hooks holding to the bottom slot walls thereof, so that when the wire is installed in a produce tray, by being sequentially inserted up through a slotted bottom opening and a slotted top opening in such tray, it will be compressed so that the sides thereof are essentially parallel and so that the hook-shaped feet of the wire are pressed against the end walls of the bottom slot of the produce tray and are held in place with respect to such bottom slot of the produce tray, and have the ends thereof digging into such tray bottom, and the outer end walls of the slot in the tray bottom are farther apart than are the end walls in the slot in the tray top.

7. A berry or cherry tomato produce tray having installed therein a pair of stacking wires to facilitate stacking of a plurality of such trays to heights of from 2 to 16 trays, or more, which tray comprises a substantially flat bottom and low, substantially vertical side and end wall portions, with aligned slots in bottom and top portions of the end walls extending in the directions of such walls, and with the slots in the bottom portions being longer than those in the top portions thereof, with each of the stacking wires being of a unitary length of wire bent so as to form an elongated "U" shape with a pair of sides thereof joined together at an upper end and extending downwardly and pressing outwardly against end walls of the upper slot and, at a location below the upper slot and above the lower slot of the tray, extending downwardly and outwardly in the form of diverging legs which are at an angle of at least 20° with respect to continuations of the wire sides, and having extensions thereof which terminate in hook-shaped feet, having hook openings facing outwardly, with ledges thereof fitting about portions of the tray bottoms at the bottom slot ends, with the hook-shaped feet being pressed against the slot ends by the other parts of the wire due at least in part to the angle of the outwardly diverging legs thereof being greater than 20°, which holds the hook ledges against the tray bottom and helps to prevent dislodging of the wire when it is subjected to downward and/or sideward force on the upper end thereof, and which hooks of the feet have ends thereof bent upwardly so that they dig into the bottom of the tray bottom when the tray is pressed downwardly onto such ends while the tray and such ends are supported.

8. A produce tray-stacking wires combination according to claim 7 wherein the angle at which the legs diverge with respect to continuations of the wire sides and to the vertical is in the range of 20° to 30°, the wire is of a high tensile strength steel, alloy steel or cold worked alluminum and is pre-sprung to promote bearing of the wire sides and hook portions against the tray slot and walls, the leg extensions of the wire are substantially parallel and vertical, as installed in the tray and the upper ledge sections of the hook-shaped feet are long enough to resist being pushed downwardly through the slot in the bottom of the tray in response to downward or sideward forces against the wire because of the transmission of such force through the diverging portions of the wire sides which press the hook portions of the feet against the end walls of the slots in the tray bottom.

9. A produce tray-stacking wires combination according to claim 8 wherein the outwardly bent ends of the hooks of the stacking wires are at an angle at least 10° above the horizontal and are embedded in the tray bottom, the material of the stacking wire is a steel of tensil strength in the range of 4,000 to 8,000 kg./sq. cm., the wire is from 10 to 14 gauge, U.S. Steel Wire Gauge, and the angle of the upper ledge portion of the hook is less than 15° with the horizontal.

10. A produce tray-stacking wires combination according to claim 9 wherein the bottom slots in the produce tray are from 3 to 15 mm. longer than the upper slots of such tray, the upper ledge portion of the hook is from 0.6 to 1 cm. long and the produce tray-stacking wires combination is stacked with other such combination(s) to form a stack from two to 16 units high.

* * * * *